United States Patent [19]

Rowlands

[11] 4,265,043

[45] May 5, 1981

[54] EXTRACTOR ARRANGEMENT FOR FIREARMS

[76] Inventor: Kenneth C. Rowlands, 612 Pauline Ave., Utica, N.Y. 13502

[21] Appl. No.: 71,279

[22] Filed: Aug. 30, 1979

Related U.S. Application Data

[63] Continuation-in-part of Ser. No. 28,503, Apr. 9, 1979, abandoned.

[51] Int. Cl.[3] ..... F41C 15/12

[52] U.S. Cl. ..... 42/25

[58] Field of Search ..... 42/25, 16

[56] References Cited

U.S. PATENT DOCUMENTS

| | | | |
|---|---|---|---|
| 2,473,373 | 6/1949 | Howell | 42/25 |
| 2,585,195 | 2/1952 | Walker | 42/25 |
| 3,738,223 | 6/1973 | Post et al. | 42/25 |
| 3,738,224 | 6/1973 | Post et al. | 42/25 |

*Primary Examiner*—Charles T. Jordan

[57] ABSTRACT

A cartridge extractor, comprising a resilient ring segment formed with a claw, is mounted within a recessed bolt face without a rivet. The wall of the bolt recess is formed with an arcuate clearance cut, radius cuts at either end of the clearance cut, and projecting lobes at the junctions of these cuts. The extractor ring has its free ends bent to form detent arms, which are seated in the radius cuts to support the claw in a position to engage a cartridge base as it enters the recess. This deflects the ring into the clearance cut, guided by the detent arms sliding over the lobes. When the claw seats in the extraction groove of the cartridge, the ring is guided back to its original position by the detent arms re-seating themselves in the radius cuts.

For use in auto-loading firearms whose bolts rotate violently, a means is added to prevent relative rotation of the extractor ring, without interfering with its normal deflection. This may be a pin or a protrusion extending into the clearance cut, or a tail on the extractor engaged in a hole in the bolt.

17 Claims, 19 Drawing Figures

EXTRACTOR ARRANGEMENT FOR FIREARMS

This application is a continuation-in-part of my application Ser. No. 28,503 filed Apr. 9, 1979, abandoned.

BACKGROUND OF THE INVENTION

The present invention relates in general to firearms, and more particularly to an improved cartridge extractor of the ring type for use in breech loading guns.

A ring extractor of a kind now in widespread use consists of a resilient steel spring in the form of an arcuate ring segment, which is formed midway of its arcuate length with an extractor claw for engaging an extraction groove or rim at the base of a cartridge. The ring extractor is mounted by deflecting and inserting it into an annular recess which is formed in the face of the firearm's bolt. The recess is surrounded by an annular shroud or collar, which is formed behind the bolt face with an eccentric clearance cut projecting radially outwardly to receive and trap the extractor. When the bolt is moved to closed position, the extractor claw is deflected into the clearance cut as the cartridge enters the recess; the claw then snaps into the extraction groove in the cartridge base. When the bolt is re-opened, a spring-loaded ejector pin pivots the cartridge about the claw then engaged in its extraction groove, and ejects it from the firearm.

It is a conventional practice to secure the ring extractor in its proper circumferential position relative to the clearance cut and the ejector, by riveting it at one end through the wall of the bolt shroud; indeed, all models of centerfire rifles currently being made by applicant's assignee include a ring extractor riveted in this fashion. However, there are a few practical disadvantages associated with this riveting, both in use and manufacture. The extractor is difficult to replace and re-rivet if a failure occcurs in the field. Brass shavings and dirt particles occasionally accumulate in the shroud behind the extractor, hindering its operation, and cleaning them out is difficult.

As to manufacturing problems, a number of special machining, assembly, and hand blending operations on the bolt head are required to accommodate the extractor rivet. Further, the position of the extractor claw relative to the bolt recess, which is critical, cannot be held with consistent accuracy through its manufacturing and heat treatment operations, and must be compensated by reforming the extractor after it is riveted in place.

A rivetless extractor was proposed in U.S. Pat. No. 2,473,373—Howell, issued June 14, 1949 and assigned to the owner of the present application. According to that patent, the extractor ring is free to rotate within limits set by forming staked indents extending into the recess wall from the annular lip at its front. The wall of the recess has a circular cross-section, without the customary relief cut, while the extractor ring has circular arcuate portions near its ends to serve as bearing surfaces engaging this wall. The claw portion lying between the circular portions of the ring is a relatively flat arc which normally has clearance from the recess wall, leaving room for it to deflect outwardly to pass a cartridge base. It appears that this extractor was used for a time by applicant's assignee in a bolt-action rifle, but was later dropped in favor of a riveted extractor.

SUMMARY OF THE INVENTION

This invention has as its general object the provision of an improved rivetless ring extractor arrangement which is highly durable, and is very easy to clean or to replace. The improved extractor also features simplified manufacture and assembly; and its function is not adversely affected by the minor dimensional variations which are normally caused by heat treatment.

The improved ring extractor comprises an arcuate ring segment whose free ends are curved out from the body of the ring to serve as detent arms. These arms are normally received in a pair of radius cuts spaced around the wall of the bolt recess, which also has a clearance cut lying between the two radius cuts to permit outward deflection of a central claw portion of the ring. The regions of the recess wall at the intersections between the radius cuts and the intermediate clearance cut form lobes which project inwardly. The detent arms, normally resting in the radius cuts, are cammed out of place by these lobes when a cartridge base deflects the central claw portion of the extractor into the intermediate clearance cut. When the cartridge reaches its seated position in the recess and the claw is free to enter its extraction groove under the bias of the deflected extractor, this bias also acts against the lobes to bring the detent arms back into their normal, undeflected portions in the radius cuts. The deflections of the extractor ring are not localized at any point, but are distributed throughout its length, which avoids the tendency of a rivet to concentrate bending stresses near the fastening point.

In those autoloading firearms which have a rotating bolt, the motions of the bolt are apt to be violent. The frictional force between the extractor claw and the cartridge case can become great enough to prevent the extractor from turning with the bolt, moving it out of its proper angular position and possibly damaging the detent arms. In applications of this kind, such displacement is prevented by adding a suitable anti-rotation means. This may consist of a tail extending from the extractor ring into a hole bored into the wall of the surrounding recess, or a pin seated in such a hole and extending into the recess in a position to interfere with rotation of the ring. Alternatively, the bolt may be coined to form a projection extending into the recess, for the same purpose.

DETAILED DESCRIPTION

Figure 1:
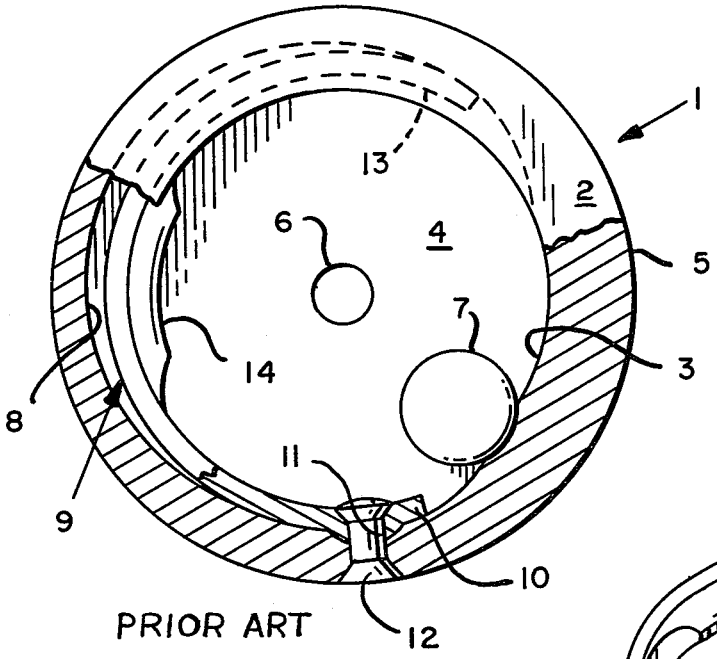
FIG. 1 is a fragmentary end view of a firearm bolt having a typical prior-art riveted extractor arrangement.
Figure 2:
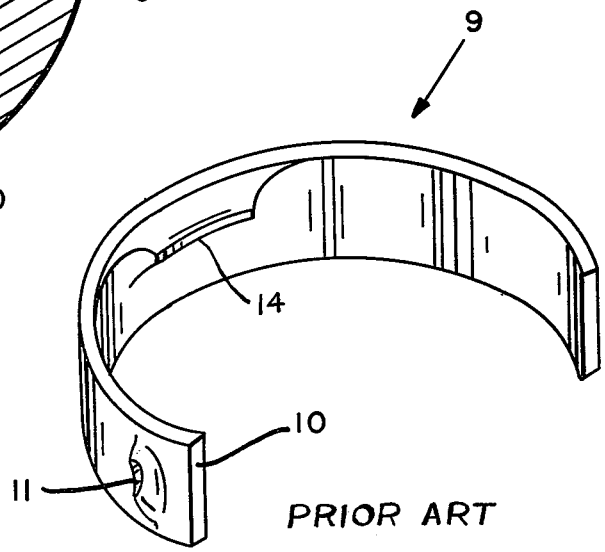
FIG. 2 is a pictorial view of the extractor ring of FIG. 1, removed from the firearm.
Figure 3:
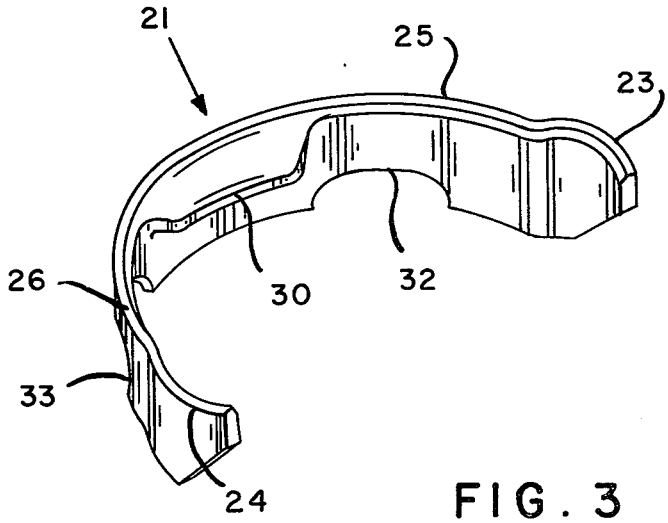
FIG. 3 is a pictorial view of a rivetless extractor ring made in accordance with the present invention.

FIGS. 1 and 2 show a typical riveted extractor arrangement of a kind now in use, applied in this illustrative case to a generally cylindrical breech-bolt 1, whose forward face 2 is adapted to close against the barrel (not shown) of a firearm in a conventional manner. A cylindrical recess 3 is bored into the face 2, terminating rearwardly in a flat seat 4, and surrounded by a shroud or collar 5. The recess is dimensioned to receive the head of a cartridge, which is seated in the recess by the closure of the bolt, as the forward portion of the cartridge is seated in the chamber (not shown) of the barrel. A conventional firing pin and ejector are mounted for movement axially of the bolt in bores 6 and 7 located at the center and at one side of the recess, respectively. The wall of the recess is formed with an arcuately-extending clearance cut 8, which does not open onto the bolt face 2.

An extractor ring 9, comprising a resilient steel ring segment, is inserted into the clearance cut 8 by compressing it enough to pass into the recess 3, and then allowed to expand into the clearance cut, which traps it behind the bolt face. One of its free ends 10 has a rivet hole 11 for receiving a rivet 12 to secure the ring in a fixed angular position with respect to the shroud 5 and the ejector bore 7. The remaining free end 13 of the ring is left free so that the ring can be elastically deflected in radial directions in and out of the clearance cut 8.

A claw 14 is formed in the center of the arc of the extractor ring 9, and projects as shown into the opening of the recess 3 in the normal, undeflected position of the ring. When the bolt 1 is closed on the base of a cartridge (not shown in FIG. 1), which has a diameter only slightly smaller than that of the recess, the claw 14 is cammed out of the way by the cartridge, causing the ring 9 to deflect into the clearance cut 8. As the cartridge seats in the base of the recess, its extraction groove reaches a position to receive the claw 14, and the ring 9 relaxes by moving radially inwardly to the illustrated postion. Subsequent opening of the bolt 1 is accompanied by withdrawal of the cartridge case by the claw from the firearm chamber (not shown); when the case clears the chamber, the spring-loaded ejector flips it sideways out of the recess, the claw 14 serving as a fulcrum for the ejecting movement.

This cycle of operation is accompanied by repeated elastic deflection of the ring 9 about its riveted end 10, which, being fixed in the manner of a cantilever beam, is subjected to a concentration of bending stress near the rivet hole 11. Consequently, this type of riveted extractor has a somewhat limited life expectancy.

Proper operation of the extractor of FIGS. 1 and 2 requires that the clearance space 8 be kept reasonably free of dirt and brass shavings so that the ring 9 may deflect freely into it, and it is difficult to clean this space because of the riveted construction.

Referring now to FIGS. 3–6, the improved rivetless extractor arrangement of the present invention includes a resilient flexible extractor ring 21 in the form of an arcuate ring segment. The free ends 23 and 24 of the ring form detent arms curved outwardly from the generally circular arc of the central portion, which includes spring arms 25 and 26 and a claw 30. Two relief cuts 32 and 33 are formed in the spring arms to collect brass shavings and dirt particles which normally accumulate, and to enable the user to easily shake or blow them out.

Figure 4:
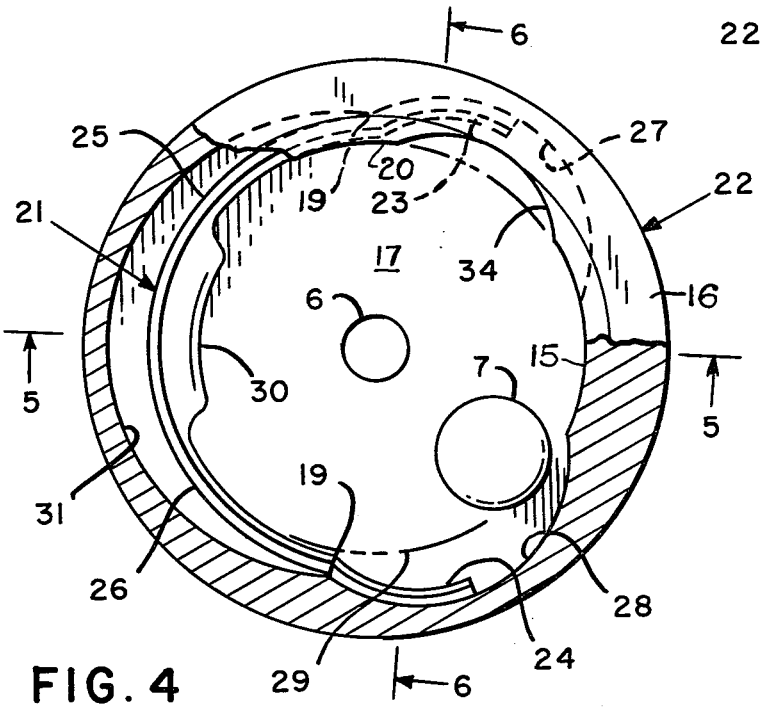
FIG. 4 is a fragmentary end view showing the extractor of FIG. 3 assembled in a recess formed in the face of a firearm's breech-bolt.
Figure 6:
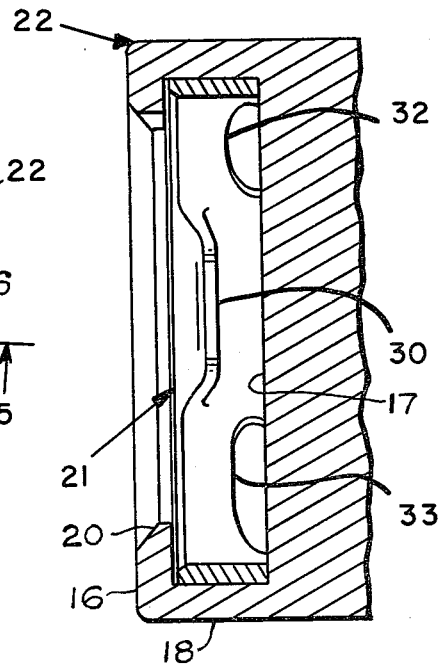
FIG. 6 is a fragmentary sectional view taken along line 6—6 in FIG. 4, looking in the direction of the arrows.
Figure 5:
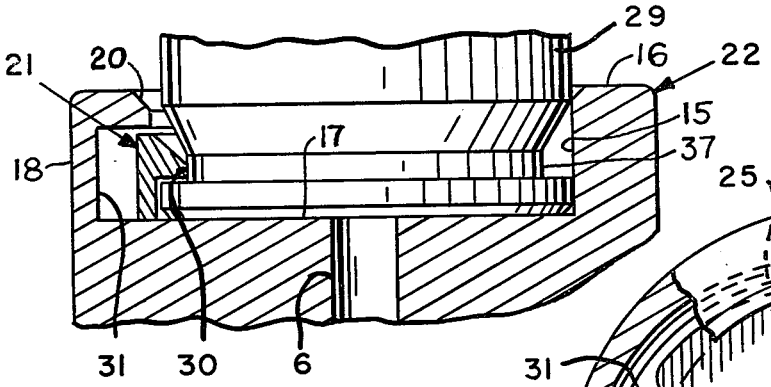
FIG. 5 is a fragmentary sectional view taken along line 5—5 in FIG. 4, looking in the direction of the arrows.

As shown in FIGS. 4–6, a bolt head 22, of a form appropriate to any given type of firearm, is provided with a cylindrical recess 15 extending rearwardly from its barrel-engaging face 16 to a flat seat 17. The diameter of the recess is slightly larger than that of a cartridge case 29, which enters the recess and engages the seat 17 as the bolt is closed to position the cartridge in the chamber of the barrel (not shown). The recess defines a shroud or collar 18 adjacent to the bolt face, which fully encloses that portion of the cartridge base protruding from the barrel, contributing materially to the safety of the firearm.

A conventional ejector is slidably received in the bolt, spring-biased to project into the recess 15 to eject a cartridge case when the bolt is opened. A suitable bore 6 is also formed at the center of the recess to receive a conventional firing pin (not shown).

A clearance cut 31 and two symmetrically-spaced radius cuts 27 and 28 are formed in the circumferential wall of the recess 15, defining two inward projections or lobes 19 at their intersections. These cuts do not extend to the bolt face, but an arcuate lip 20 remains to trap the extractor ring in the recess. The extractor ring 21 is assembled in the bolt 22 simply by elastically deflecting it enough to pass into the recess, and then allowing it to expand into the clearance cut 31. A small relief cut 34 in the lip 20 may be desirable to facilitate this assembly procedure and avoid overstressing the extractor, especially in small caliber applications. As the ring expands, it is turned by its spring bias, acting against the lobes 19, to seat the detent arms 23 and 24 in the radius cuts 27 and 28.

Figure 7:
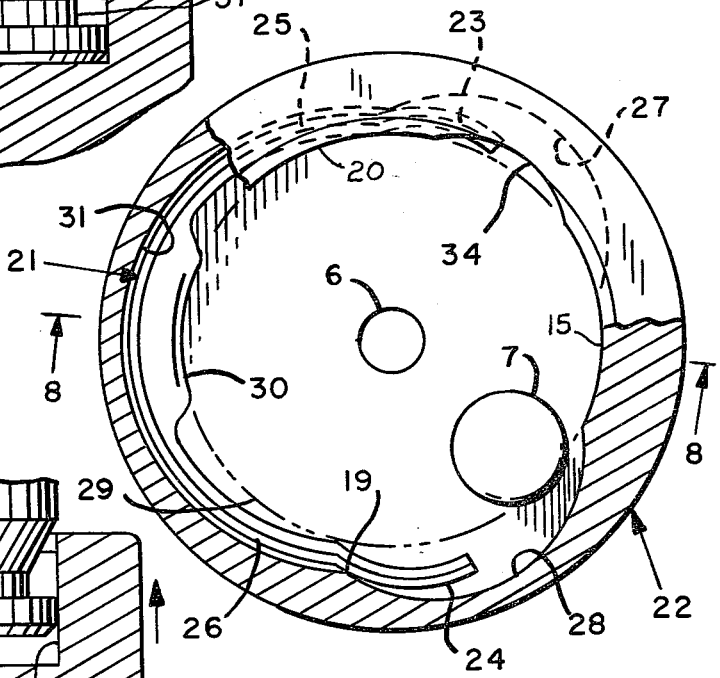
FIG. 7 is a fragmentary end view similar to FIG. 4, but showing the extractor in a deflected position which it assumes as the bolt closes on the base of a cartridge.
Figure 8:
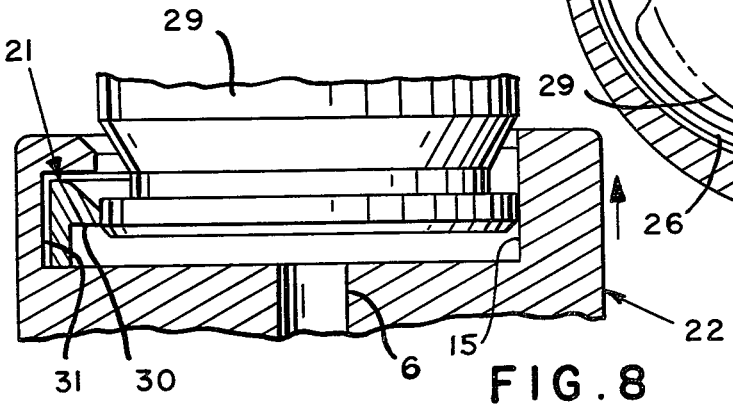
FIG. 8 is a fragmentary sectional view taken along line 8—8 in FIG. 7, looking in the direction of the arrows.

The spring arms 25 and 26 are normally spaced away from the outer wall of the clearance cut 31 as shown, and the claw 30 projects outwardly into the recess 15, in a position to interfere with the insertion of the base of a cartridge case 29. As shown in FIGS. 7 and 8, a forward movement of the bolt 22 in the direction shown by the arrow cases the base of the cartridge to engage and cam the claw 30 outwardly into the clearance cut. This action is accommodated by elastic deflection of the spring arms 25 and 26 into the clearance cut, and a sliding motion of the detent arms 23 and 24 out of the radius cuts 27 and 28 and over the lobes 19.

Completion of the bolt-closing movement brings the claw 30 into axial alignment with the conventional extraction groove 37 of the cartridge. The spring bias of the deflected extractor ring is then free to expand it back into the position of FIGS. 4–6; and the detent arms 23 and 24 are cammed over the lobes 19 into their seated positions in the radius cuts 27 and 28. Subsequent opening of the bolt causes the claw 30 to draw the case 29 out of the firearm chamber, and this is followed by a forward motion of the spring-biased ejector, which flips the case out of the firearm by turning it around the claw as a fulcrum.

The relief cuts 32 and 33 serve not only to collect dirt in a manner that facilitates its removal, but also lower the spring constant of the extractor ring by reducing the width of spring material. This contributes to the ease of assembly and disassembly of the extractor, without detracting from its service life.

The extractor arrangement of FIGS. 3–8 is highly satisfactory for use in manually-operated firearms, and tests made thus far indicate a very long useful life in these applications.

In auto-loading firearms, however, the rotation of the bolt while opening and extracting a shell case is quite violent, and the frictional force between the claw 30 and a case that sticks in the chamber may become large enough to prevent the extractor ring from rotating with the bolt. This tends to deform the detent arms 23 and 24, and may eventually cause the claw to protrude too far into the recess 15 to admit a cartridge. To prevent this extractor rotation from occurring, anti-rotation means are preferably provided for applications of the invention to auto-loading firearms.

Figure 9:
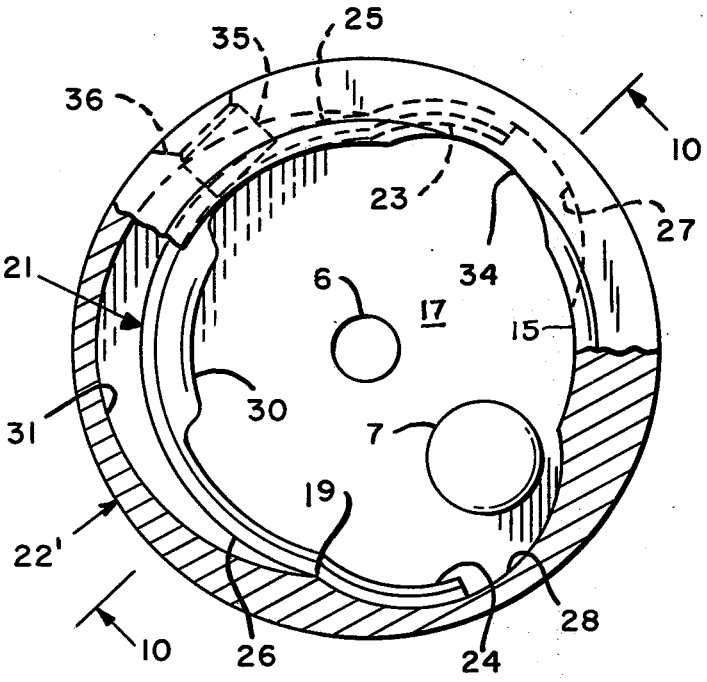
FIG. 9 is a fragmentary end view showing an extractor arrangement especially adapted for use in autoloading firearms, modified by the addition of an anti-rotation pin.
Figure 10:
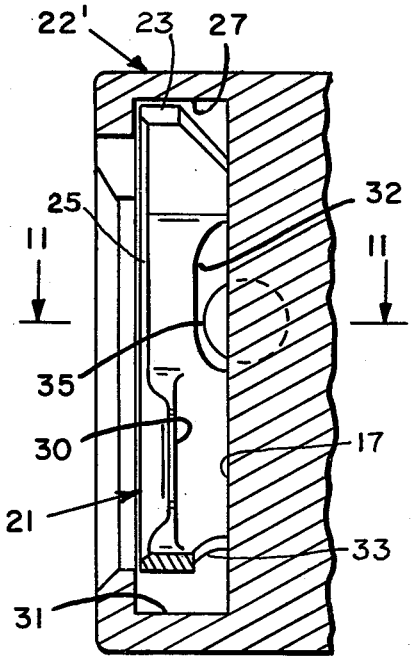
FIG. 10 is a fragmentary sectional view taken along line 10—10 in FIG. 9, looking in the direction of the arrows.
Figure 11:
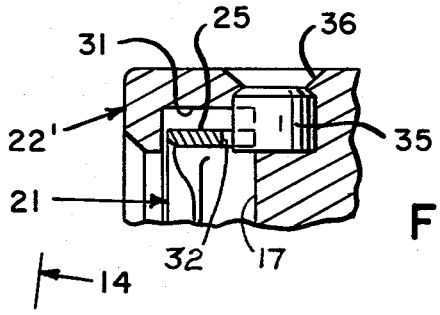
FIG. 11 is a fragmentary sectional view taken along line 11—11 in FIG. 10, looking in the direction of the arrows.

These anti-rotation means may take the form of a pin 35 shown in FIGS. 9–11, in which elements like those of the preceding embodiment are similarly numbered. A flat-bottomed hole 36 is bored through the side of the bolt 22', communicating with the clearance cut 31 near its rear surface 17, and circumferentially aligned with the relief cut 32 near the claw 30. The pin 35 is inserted in this hole and secured by staking the metal around the opening. The pin projects into the relief cut to prevent the extractor 21 from rotating appreciably in one direction; as pictured in FIG. 9, it is assumed that the bolt rotates counterclockwise on opening, and the pin is therefore arranged to prevent clockwise slippage of the extractor. If the bolt were arranged to open with clockwise rotation, the pin 35 would preferably be set into the relief cut 33, to prevent slippage of the extractor in the reverse direction. An alternative location of the pin in circumferential alignment with the center of the claw 30 has been tried, but since this requires a relief cut in the ring at this point of high stress, it may result in a shortened extractor life, and is not preferred.

Figure 12:
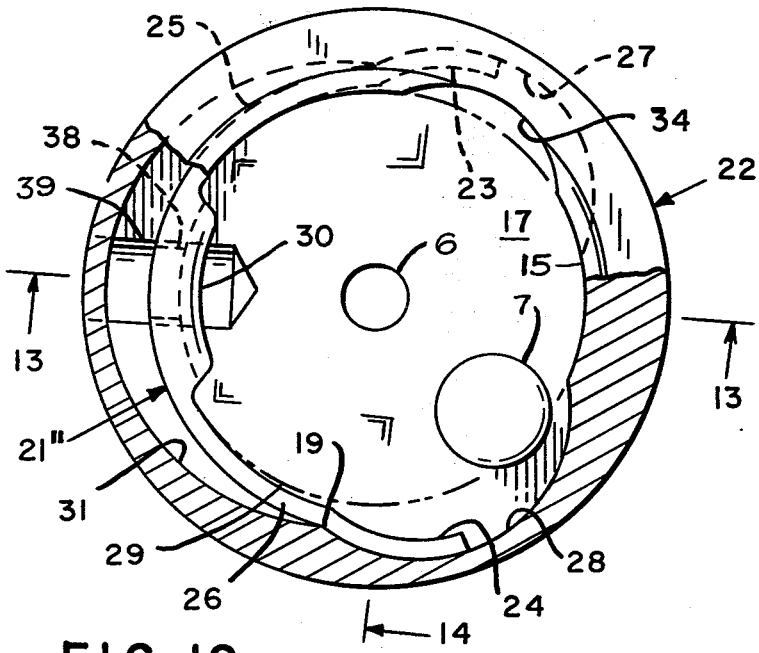
FIG. 12 is a fragmentary end view showing another arrangement adapted for use in autoloading firearms, modified by the addition of an anti-rotation tab on the extractor ring.
Figure 14:
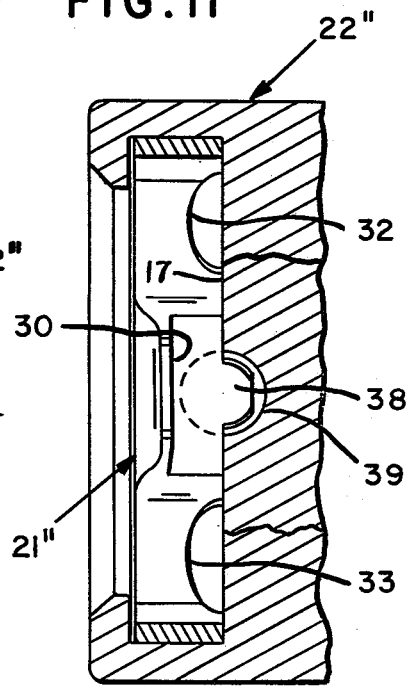
FIG. 14 is a fragmentary sectional view taken along line 14—14 in FIG. 12, looking in the direction of the arrows.
Figure 13:
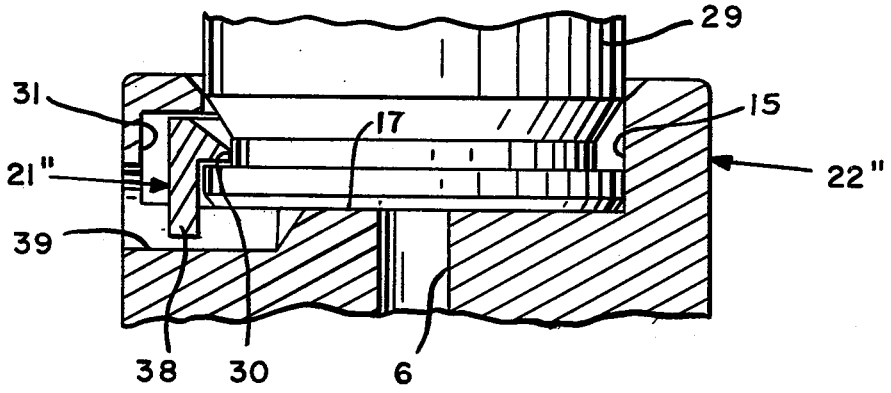
FIG. 13 is a fragmentary sectional view taken along line 13—13 in FIG. 12, looking in the direction of the arrows.

Another anti-rotation means, comprising a projecting tail 38 formed in an extractor ring 21'', is shown in FIGS. 12–14; again, elements like those of the preceding embodiments are similarly numbered. The tail 38 is preferably circumferentially aligned with the claw 30, the point of application of frictional torque. A radial hole 39 is bored through the side of the bolt 22'', extending into the rear face 17 of the recess 15 to provide a radiused slot for receiving the tail 38. Clearance is provided for fore-and-aft working of the tail in the hole 39, but any substantial amount of relative rotation is prevented.

Figure 15:
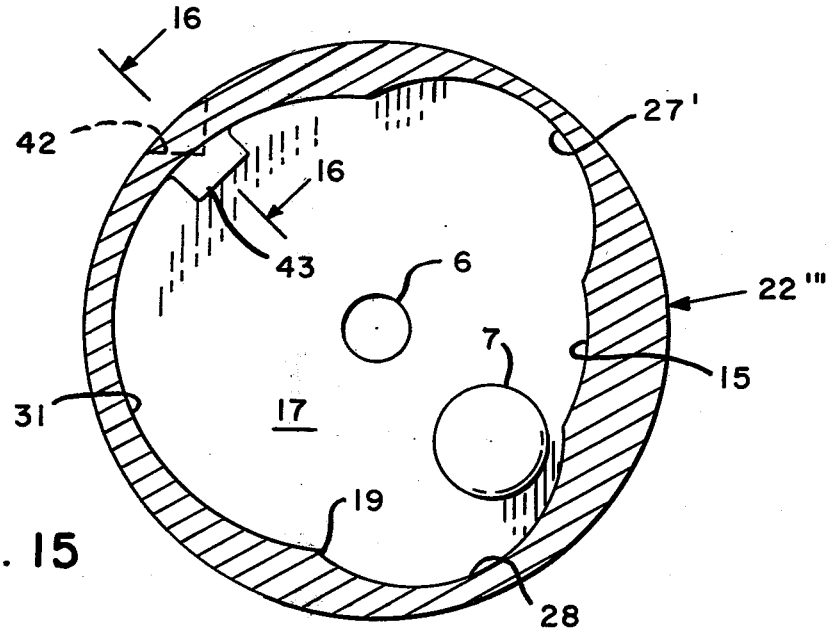
FIG. 15 is a sectional end view showing a bolt modified by the addition of a coined projection, which is an alternative anti-rotation means.
Figure 16:
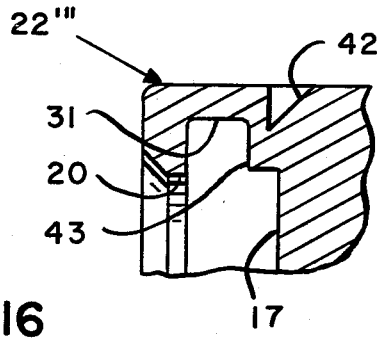
FIG. 16 is a fragmentary sectional view taken along line 16—16 in FIG. 15, looking in the direction of the arrows.

A third alternative form of anti-rotation means is shown in FIGS. 15 and 16, comprising a generally hemicylindrical projection 43 formed in the recess 31 of a bolt 22''', blended into the seating surface 17. This projection is circumferentially located in the same position as the pin 35 of FIGS. 9–11 relative to the extractor ring, (which is not shown in these figures to impove their clarity), and functions in the same manner. It may be formed by coining, using a punch which leaves a slight depression 42 in the outer surface of the bolt. A forming die must be placed against the interior surfaces 31 and 17, and I have found it necessary to rigidly confine the outer surface of the bolt as well, to avoid distorting the bolt.

Figure 17:
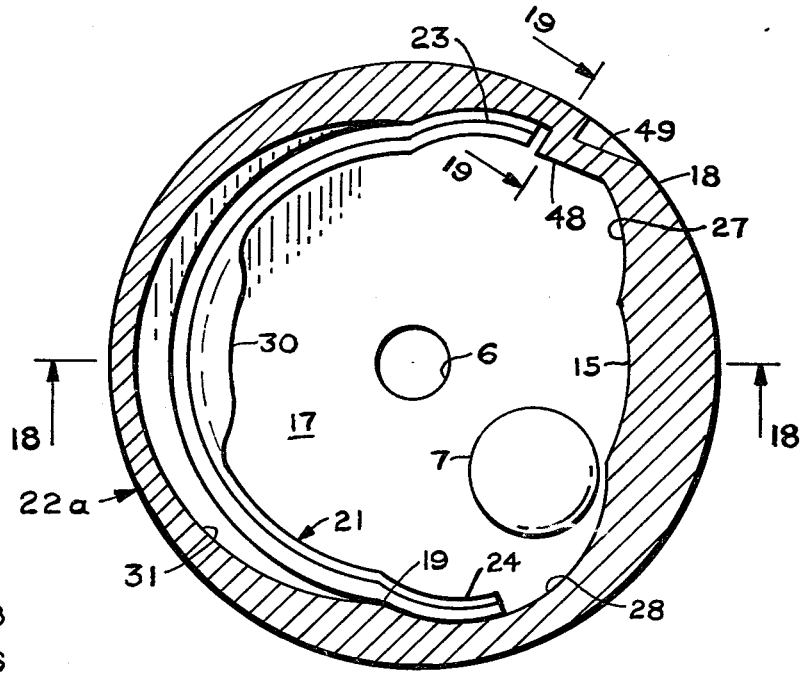
FIG. 17 is a sectional end view showing a bolt with a coined projection situated differently from that of FIGS. 15 and 16.
Figure 19:
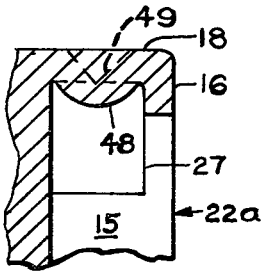
FIG. 19 is a fragmentary sectional view taken along line 19—19 in FIG. 17, looking in the direction of the arrows.
Figure 18:
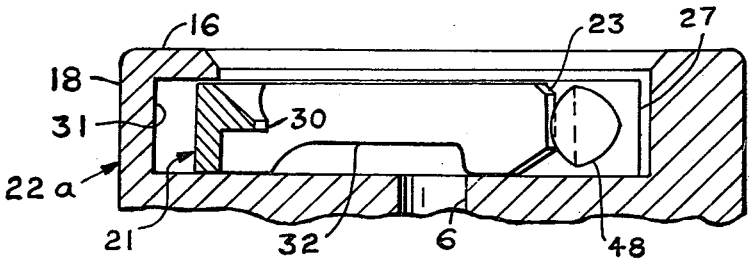
FIG. 18 is a fragmentary sectional view taken along line 18—18 in FIG. 17, looking in the direction of the arrows.

Because of the complexity this entails, the location of the projection 43 shown in FIGS. 15 and 16 is not the most favored. I have found it more convenient to form it as shown at 48 in FIGS. 17–19, within one of the radius cuts 27 of a bolt **22*a*. At this location, a punch is applied to coin the material of the shroud 18 against a suitable die (not shown) to form the projection 48, leaving a depression 49 in the shroud. This operation does not require confining the external bolt surface to avoid distorting it. The projection 48 prevents rotation of the extractor 21 by abutment with the end of one of its detent arms 23. It is assumed in FIG. 17 that the bolt rotates counterclockwise to unlock; but it will be apparent that if the bolt were arranged to unlock by clockwise rotation, the projection 48 should be placed in the radius cut 28** instead.

It should be noted that none of the anti-rotation means shown in FIGS. 9–19 interferes in any way with ready removal and replacement of the extractor ring. Current results of tests in auto-loading rifles tend to show that a striking increase in life expectancy can be expected for these designs, as compared with the riveted extractor of FIGS. 1–2.

What I claim is:

1. In a firearm of the type which includes a breechbolt having a face formed with an annular shroud having an interior circumferential wall defining a recess for receiving the base of a cartridge, and a resilient extractor ring segment received in said recess and formed with a claw in a central portion thereof for engaging the cartridge base, an improved extractor arrangement comprising:

said extractor ring segment having free end portions at opposite ends of the arc length thereof bent outwardly to form detent arms;

said interior wall being formed with an arcuate clearance cut, and having a pair of projections circumferentially spaced thereabout, said clearance cut extending said recess outwardly into said shroud and defining a lip lying between said clearance cut and said bolt face;

said detent arms normally engaging said projections to position said central portion of said ring segment in circumferential alignment with said clearance cut and in spaced-apart relation to said interior wall, said ring segment being displaceable to admit a cartridge base into said recess by deflecting radially outwardly toward said interior wall with an accompanying sliding motion of said detent arms with respect to said projections.

2. The extractor arrangement of claim 1, in which said interior wall is formed with a pair of radius cuts located at opposite ends of the arc length of said clearance cut, said radius cuts and said clearance cut intersecting to form said projections in said interior wall.

3. The extractor arrangement of claim 2, said detent arms being formed to conformably engage the portions of said interior wall lying in said radius cuts.

4. The extractor arrangement of claim 1, said projections being circumferentially located to normally engage said detent arms at the junctions between said detent arms and said central portion of said ring segment.

5. The extractor arrangement of claim 1, said recess having a substantially circular opening onto said bolt face defined by said shroud and said lip therein, said clearance cut being eccentric to said circular opening, said central portion of said extractor ring segment being constructed and arranged to lie within said clearance cut with said claw protruding into said circular opening.

6. The extractor arrangement of claim 5, in which said interior wall is formed with a pair of radius cuts located at opposite ends of the arc length of said clearance cut, said radius cuts and said clearance cut intersecting to form said projections in said interior wall, said radius cuts being eccentric to said circular opening and being separated from said bolt face by said lip.

7. The extractor arrangement of claim 1, together with anti-rotation means constructed and arranged to prevent substantial rotation of said ring segment relative to said breech-bolt in at least one angular direction, but to allow freedom of deflection of said ring segment in a radial direction.

8. The extractor arrangement of claim 7, in which said anti-rotation means is secured to said bolt and protrudes into said recess to interfere with relative rotation of said extractor ring segment.

9. The extractor arrangement of claim 8, in which said anti-rotation means comprises a pin, and said shroud is formed with an opening extending into said recess for receiving said pin.

10. The extractor arrangement of claim 8, in which said anti-rotation means comprises a projection integrally formed in said interior wall and extending into said recess.

11. The extractor arrangement of claim 8, in which said central portion of said extractor ring segment is formed with at least one relief cut circumferentially spaced from said claw and positioned to receive said anti-rotation means therein.

12. The extractor arrangement of claim 7, in which said anti-rotation means is secured to said extractor ring segment, and the interior of said recess is formed to interengage with said anti-rotation means to interfere with rotation of said extractor ring segment.

13. The extractor arrangement of claim 12, in which said anti-rotation means comprises a tail projecting from said extractor ring segment.

14. The extractor arrangement of claim 13, in which said shroud is formed with an opening extending into said recess for receiving said projecting tail.

15. In a firearm of the type which includes a breech-bolt having a face formed with an annular shroud having an interior circumferential wall defining a recess for receiving the base of a cartridge, and a resilient extractor ring segment received in said recess and formed with a claw in a central portion thereof for engaging the cartridge base, an improved extractor arrangement comprising;

said extractor ring segment having free end portions at opposite ends of the arc length thereof bent outwardly to form detent arms;

said interior wall being formed with an arcuate clearance cut, and with a pair of radius cuts located at opposite ends of the arc length of said clearance cut, said clearance cut and radius cuts extending said recess outwardly into said shroud and defining a lip lying between said cuts and said bolt face:

said detent arms normally being seated in said radius cuts to locate said claw and central portion of said ring segment in circumferential alignment with said clearance cut and in spaced-apart relation to said interior wall, said ring segment being displaceable to admit a cartridge base into said recess by deflecting radially outwardly toward said interior wall with an accompanying sliding motion of said detent arms with respect to said radius cuts.

16. In a firearm, the combination comprising:

a bolt having a face formed with an annular shroud having an interior circumferential wall defining a recess for receiving the base of a cartridge, said interior wall including a clearance cut separated from said bolt face by an intervening lip;

a resilient extractor ring segment received in said recess and extending into said clearance cut behind said lip;

said ring segment having a central portion formed with an extractor claw, and having opposite free ends thereof formed with detent arms projecting outwardly therefrom, said detent arms bearing against said interior wall and normally supporting said central portion out of contact therewith;

said interior wall having a pair of lobes circumferentially spaced thereabout and projecting therefrom to engage and locate said detent arms;

said central portion being resiliently deflectable outwardly toward said peripheral wall by a cartridge base entering said recess, said detent portions being slidable over said lobes to accommodate the deflection of said central portion.

17. In a firearm, the combination comprising: a bolt having a face formed with an annular shroud having an interior circumferential wall defining a recess for receiving the base of a cartridge; said circumferential wall being formed with an arcuate clearance cut and with a pair of radius cuts located at opposite ends of the arc length of said clearance cut, said clearance cut and radius cuts extending said recess outwardly into said shroud;

a resilient extractor ring segment having a central portion formed with an extractor claw, and having opposite free end portions thereof formed with detent arms;

said extractor ring segment being received in said extended recess, and being constructed and arranged such that, in a normal undeflected condition thereof, said detent arms are received each in one of said radius cuts to support said central portion in spaced-apart relation to said interior wall and with said extractor claw positioned to engage a cartridge base entering said recess, and seating of the cartridge base in said recess is accommodated by a deflection of said central portion outwardly into said clearance cut to pass the cartridge base, and by a sliding motion of said detent arms with respect to said radius cuts.

* * * * *